United States Patent [19]

Kraynak

[11] Patent Number: 4,702,536

[45] Date of Patent: Oct. 27, 1987

[54] SAFETY DEVICE FOR BUREAU DRAWERS, CABINET DOORS AND THE LIKE

[76] Inventor: Francis Kraynak, R.D. #1 Box 392A, Uniontown, Pa. 15401

[21] Appl. No.: 935,191

[22] Filed: Nov. 26, 1986

[51] Int. Cl.[4] ..... A47B 88/00

[52] U.S. Cl. ..... 312/330 R; 312/348; 49/383

[58] Field of Search ..... 312/330 R, 348, 332, 312/22; 49/383, 404

[56] References Cited

U.S. PATENT DOCUMENTS

| | | | |
|---|---|---|---|
| 282,087 | 7/1883 | Jowett | 312/348 |
| 293,701 | 2/1884 | Baker | 312/330 |
| 1,704,411 | 3/1929 | Steffen . | |
| 1,704,964 | 3/1929 | Dilg | 312/348 |
| 1,845,470 | 2/1932 | Wood | 312/330 |
| 1,929,494 | 10/1933 | Horlick, Jr. . | |
| 2,065,685 | 12/1936 | Gaisman . | |
| 2,331,340 | 10/1943 | Mosher . | |
| 2,681,479 | 6/1954 | Dixon, Sr. . | |
| 2,686,942 | 8/1954 | Spector . | |
| 2,747,237 | 5/1956 | du Plessis . | |
| 3,462,203 | 8/1969 | Del Vecchio | 308/3.6 |
| 3,888,525 | 6/1975 | Kousens | 312/348 |
| 4,261,140 | 4/1981 | McLean | 49/383 |

*Primary Examiner*—Victor N. Sakran

*Attorney, Agent, or Firm*—Buell, Ziesenheim, Beck & Alstadt

[57] ABSTRACT

My invention provides a safety device for bureau drawers, cabinet doors and the like to prevent the accidental injury to fingers. At least one movable stile is provided around at least one opening in the face frame of a container, such as a bureau or cabinet, into which a closure member, such as a drawer or door, is inserted. The stile is pivotally attached to the stationary face frame so that the movable stile will swing into the container opening when pushed. This movement prevents fingers from being jammed between the closure member and the face frame when the closure member is slammed shut. A spring will return the stile to its closed position when the force is removed. In such a manner, the container remains closed, but offers protection against the accidental trapping of the user's fingers.

5 Claims, 4 Drawing Figures

SAFETY DEVICE FOR BUREAU DRAWERS, CABINET DOORS AND THE LIKE

BACKGROUND OF THE INVENTION

1. Field of the Invention

This invention relates generally to the field of bureau drawers and cabinet drawers, and more particularly to the field of safety devices for drawers and doors which protect fingers.

2. Description of the Prior Art

Standard drawers offer no protection against the accidental closing upon the user's fingers. When a drawer is shut, it becomes flush with the stationary face frame of a bureau. Because the face frame behind the drawer remains stationary when pushed, the accidental placement of the user's fingers within the drawer can cause pain and sometimes injury when the drawer is slammed shut. This problem is even more acute for children and this invention is particularly useful for children's furniture having drawers and doors.

Accordingly, there is a need for a device that prevents injury from the accidental closing of a drawer upon the fingers of the user. Such a device must easily accommodate existing standards for cabinet designs. Furthermore, such a device must also be able to withstand repeated use. Finally, such a device must be sufficiently simple and inexpensive to build so as to be used in goods purchased by families with young children.

SUMMARY OF THE INVENTION

My invention is specially designed so as to prevent the accidental closing of a door upon the fingers of the user. When a drawer is closed, the drawer becomes flush with a stationary face frame of the bureau. By replacing the stationary face crame immediately surrounding the drawer opening with a movable stile, my invention prevents the accidental shutting of a drawer upon the fingers of the user.

The safety device contemplated by my invention includes a movable stile which is positioned immediately between the stationary face frame of the bureau and the opening into which the drawer fits. The movable stile is pivotally attached to the stationary face frame in a manner to permit the movable stile to enter into the bureau when pushed from the outside. Tension means, such as a spring, can connect the movable stile to the stationary face frame and force the movable stile back to its closed position after the force is removed. In such a manner, when the drawer is slammed shut, the movable stile will swing into the bureau, thus preventing the user's fingers from being jammed between the drawer and the stationary face frame of the bureau.

DESCRIPTION OF THE PREFERRED EMBODIMENT

Figure 1:
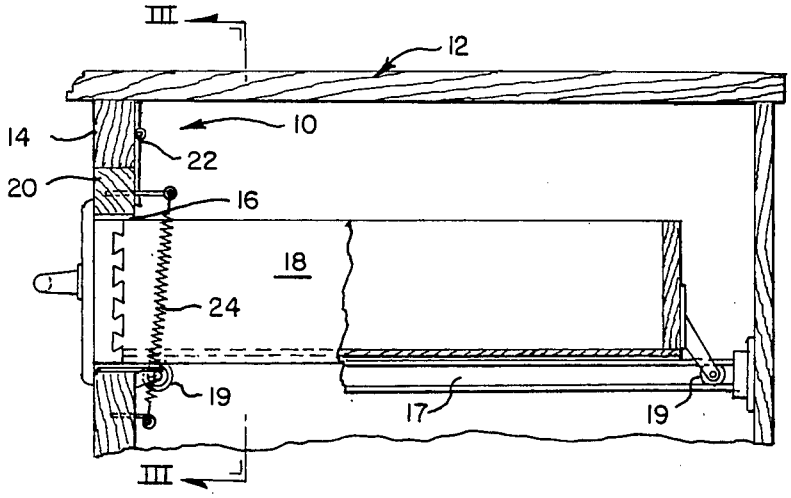
FIG. 1 is a transverse sectional view partially in elevation showing a bureau drawer having a preferred embodiment of my invention.
Figure 2:
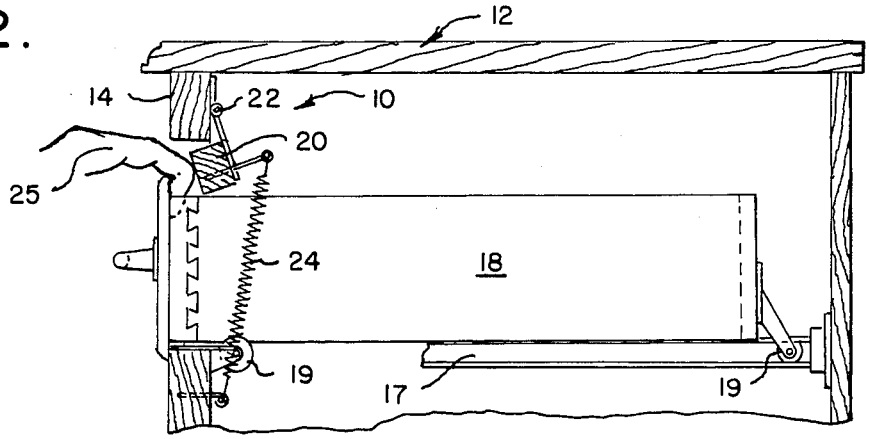
FIG. 2 is a transverse sectional view of the embodiment of FIG. 1 showing fingers inserted into the bureau drawer.
Figure 3:
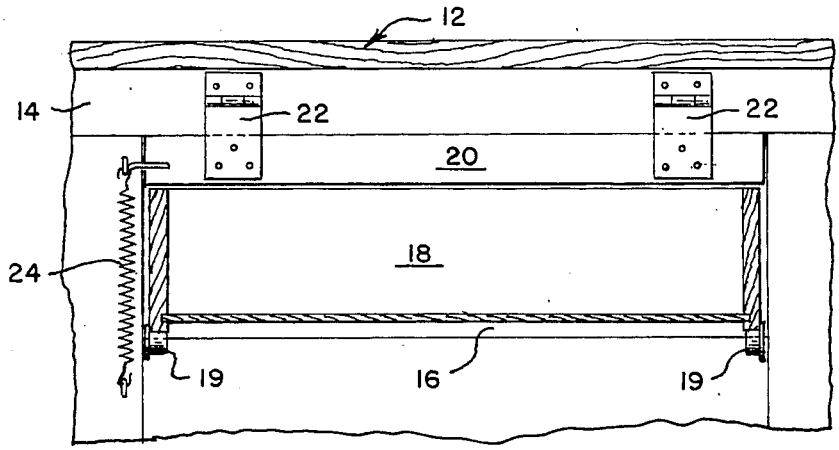
FIG. 3 is a transverse sectional view of the embodiment of FIG. 1 taken along the line III—III of FIG. 1.

As shown in FIGS. 1–3, the safety device 10 is designed to be used in containers, such as bureau 12, that have a face frame 14 having at least one opening 16 which accepts a closure member, such as drawer 18. The face frame 14 remains stationary when pushed, and drawer 18 closes flush against face frame 14. Drawer 18 is a typical drawer which rolls along guideway 17 by means of rollers 19.

To prevent injury to fingers 25, a movable stile 20 is provided immediately above opening 16. Movable stile 20 is pivotally attached to face frame 14 by means of hinges 22 so that movable stile 20 swings into opening 16 when pushed. As best shown in FIG. 3, spring 24 extends from a side of movable stile 20 to a part of face frame 14 which is on the same side of drawer 18 as the movable stile 20 but on the opposite side of opening 16, so that spring 24 will not interfere with the movement of drawer 18. If desired, another spring can be provided on the other side of drawer 18. Spring 24 maintains movable stile 20 in its closed position beneath face frame 14 until it is pushed by a force. Alternatively, torsion means can be provided in hinges 22 to maintain movable stile 20 in its closed position.

In operation, when drawer 18 is closed, it becomes flush and abuts face frame 14. However, as shown in FIG. 2, when fingers 25 or other objects overhang the top of drawer 18, movable stile 20 swings into opening 16 when drawer 18 is closed. Because movable stile 20 swings away from fingers 25, fingers 25 will not be trapped between drawer 18 and face frame 14, thus avoiding pain and injury. When fingers 25 are removed, spring 24 pulls movable stile 20 back to its closed position beneath face frame 14, where it will remain until pushed again by fingers 25.

It should be understood, that my invention applies to any container which has a stationary face frame 14 and at least one opening 16 having a closure member. Such a container can be a bureau 12 as illustrated in FIGS. 1–3 or a cabinet and other like containers. The closure member to which protection is provided can be a drawer 18 as in FIGS. 1–3, or a door, or any other similar device. Any number of drawers 18 in a bureau 12 can be equipped with the protective device described herein. Furthermore, there is no limit to the number of movable stiles 20 which can be utilized around opening 16. One side of opening 16 can be protected as in FIGS. 1–3, or any two or more sides can be provided with movable stiles 20. My safety device 10 can be used wherever there is a likelihood that the user's fingers may be caught between the closure member and the face frame 14.

Figure 4:
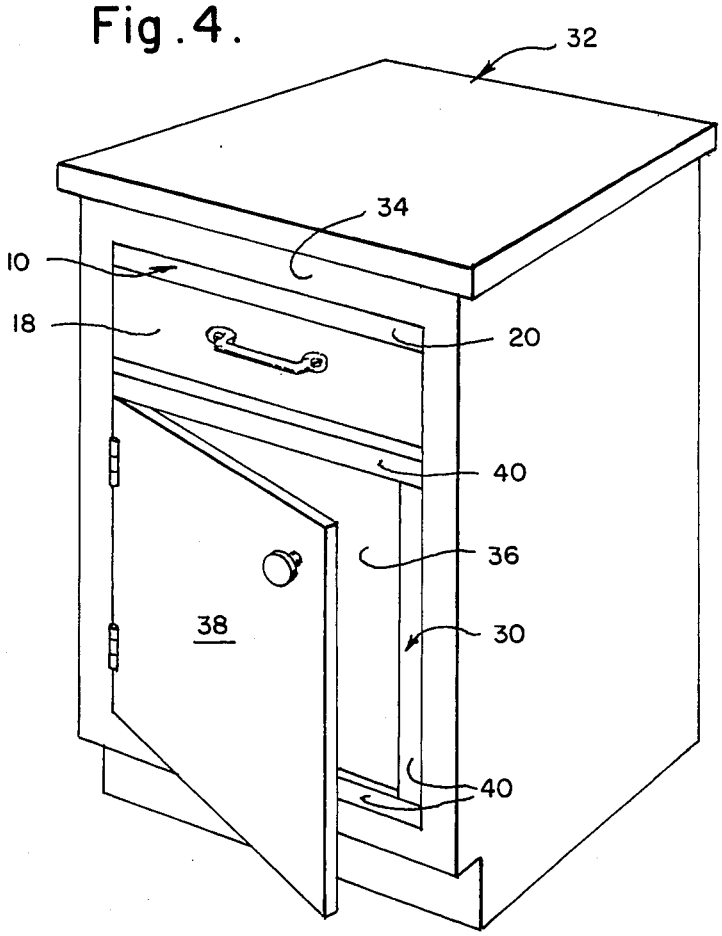
FIG. 4 is an isometric view showing an alternate embodiment of my invention.

One such other application is shown in FIG. 4. FIG. 4 shows a cabinet 32 having safety device 10 used in connection with drawer 18 as well as safety device 30. Safety device 30 is designed for use in a cabinet 32 having a stationary face frame 34 and an opening 36 over which door 38 closes. Movable stiles 40 are provided around opening 36 between opening 36 and face frame 34. These movable stiles 40 are pivotally attached to face frame 34 by means of hinges so that movable stiles 40 will swing into opening 36 when pushed. Springs, not shown, operate similarly as in bureau 12 to maintain movable stiles 40 in a flush position. The safety device 30 shown in FIG. 4 is one illustration of the use of movable stiles 40 on more than one side of opening 36. The user's fingers are protected whether they are positioned above, below or at the side of door 38 when it is closed upon face frame 34.

While I have shown and described a present preferred embodiment of the invention and have illustrated a present preferred method for practicing the same, it is to be distinctly understood that the invention is not limited thereto but may be otherwise variously embodied and practiced within the scope of the following claims.

I claim:

1. A safety device for containers having a frame member with at least one opening therein and a closure member therefor comprising:

(a) a stationary frame member located around at least one opening in the container adapted to accommodate a closure member;

(b) at least one movable stile positioned immediately between the closure member and the stationary frame member and pivotally attached to the stationary frame member so that said stile can swing from a closed position immediately adjacent the stationary frame member to an open position inside the container; and (c) tension means biasing said stile in its closed position, so that said stile will move freely into the container when forced and will return to its closed position when the force is released.

2. The device in claim 1 wherein the tension means comprises at least one spring member connected at one end to the inside of the movable stile and connected at its other end to the stationary frame member so that the spring member is directed from the movable stile toward or beyond the opening.

3. The device in claim 1 wherein the movable stile is attached to the stationary frame member by a hinge.

4. The device in claim 1 wherein the closure member is a drawer and the container is a cabinet or bureau or the like.

5. The device in claim 1 wherein the closure member is a door and the container is a cabinet or the like.

* * * * *